United States Patent [19]

Shenoha

[11] 4,453,468

[45] Jun. 12, 1984

[54] HEAT CONDUCTING MAGNETIC TYPE HOLDER FOR IMPRINTERS

[76] Inventor: James L. Shenoha, 13945 Cherokee Trail, Chickasaw Hill, Lockport, Ill. 60441

[21] Appl. No.: 454,349

[22] Filed: Dec. 29, 1982

[51] Int. Cl.[3] ..... B41F 27/02

[52] U.S. Cl. ..... 101/382 MV; 101/27

[58] Field of Search ..... 101/27, 31, 328, 368, 101/375, 377, 381, 382 MV, 391, 394

[56] References Cited

U.S. PATENT DOCUMENTS

| | | | |
|---|---|---|---|
| 1,055,770 | 3/1913 | Maidhof | 101/381 |
| 1,916,661 | 7/1933 | Flothow | 101/27 |
| 2,599,278 | 6/1952 | Osgood | 101/375 |
| 2,746,389 | 5/1956 | Alessi, Jr. et al. | 101/377 |
| 2,961,950 | 11/1960 | Kingsley | 101/381 |
| 2,978,980 | 4/1961 | Kessler | 101/382 MV |
| 3,097,592 | 7/1963 | Friedman | 101/31 |
| 3,097,598 | 7/1963 | Hotop et al. | 101/382 MV |
| 3,759,172 | 9/1973 | Conklin | 101/27 X |
| 4,010,684 | 3/1977 | La Pointe, Jr. | 101/382 MV |
| 4,154,166 | 5/1979 | Knott et al. | 101/382 MV |
| 4,228,736 | 10/1980 | Griffiths | 101/382 MV |
| 4,252,061 | 2/1981 | Wade, Jr. | 101/377 |

*Primary Examiner*—Edgar S. Burr
*Assistant Examiner*—John A. Weresh
*Attorney, Agent, or Firm*—Hill, Van Santen, Steadman & Simpson

[57] ABSTRACT

A type holder for imprinters having a heated type receiving print head utilizes a permanent magnet to hold the type in place. The magnet is mounted in a frame which is easily removed from and installed on the print head of the imprinter and is interposed between the heated print head and the type with the type directly seated or bottomed thereon to accommodate very short type blocks and provide good heat transfer from the print head to the type face. The holders are useful in both reciprocating and rotating imprinter print heads.

7 Claims, 8 Drawing Figures

HEAT CONDUCTING MAGNETIC TYPE HOLDER FOR IMPRINTERS

BACKGROUND OF THE INVENTION

1. Field of the Invention

This invention relates to the art of mounting replaceable type on imprinters and especially deals with magnetic type holders for heated print heads or spindles of imprinters.

2. Prior Art

Heretofore type holders for imprinters required elongated type blocks with keys loosely fitting the holders and with successive rows of type keyed together creating gaps permitting the type to drop out of full contact with the holder thereby greatly decreasing the heat transfer from the heated print head to the type and requiring high temperature print heads to make up for the loss in heat transfer. The elongated type blocks were expensive, about ¾ inches long, and since they could shift, smudged printing would frequently occur. It would therefore be an improvement in this art to avoid the requirement for elongated type blocks, maintain good heat transfer between the imprinter print heads and the type, and prevent shifting or movement of the type blocks during high speed operation of the imprinters.

SUMMARY OF THIS INVENTION

According to this invention, type holders for imprinters are equipped with magnets directly bottoming short type and preventing shifting or movement of the type while maintaining good heat transfer between the heated imprinter print heads and the printing faces of the type. The type need only be about ¼ to ⅜ inches long. The holders have frames sized and shaped to fit standard imprinter print heads. These frames carry a high strength permanent magnet such as an Alnico heat resisting permanent magnet which maintains its magnetic strength even at high temperatures. The frames are preferably formed of good heat conducting nonmagnetic material such as aluminum and have one or more apertures bottomed by the magnet to provide shallow type block receiving recesses or seats. Short or shallow type blocks are set in a desired array, such as in rows, in the recess to project their print faces or indicia just beyond the frame. The magnet is directly interposed between the bottoms of the type blocks and the heated print head of the printer and since it is surrounded by a good heat conducting frame, an excellent heat transfer relationship is maintained between the heated print head and the printing face or indicia of the type to accommodate hot printing at low power input. The frames may have heat insulating handles facilitating mounting and removal of the holders from the print heads. Type block lifters may be provided to facilitate removal of tightly fitting blocks from the frame recess.

It is then an object of this invention to provide magnetic type holders for imprinters.

Another object of this invention is to provide removable type holders for imprinters with permanent magnets retaining the type.

Another object of the invention is to provide type holders for heated print heads of imprinters which have frames sized and shaped to fit the print heads of standard imprinters with permanent magnets secured in the frames to bottom the type and provide good heat transfer relation between the print head and the printing face of the type.

Another object of the invention is to provide type holders having frames of good heat conducting material sized and shaped to snugly fit imprinter print heads or spindles and carrying permanent magnets in direct contact with the print heads or spindles and the type.

Other and further objects of this invention will become apparent to those skilled in this art from the following detailed description of the annexed sheets of drawings, which by way of preferred examples illustrate several embodiments of the invention.

ON THE DRAWINGS

AS SHOWN ON THE DRAWINGS

Figure 1:
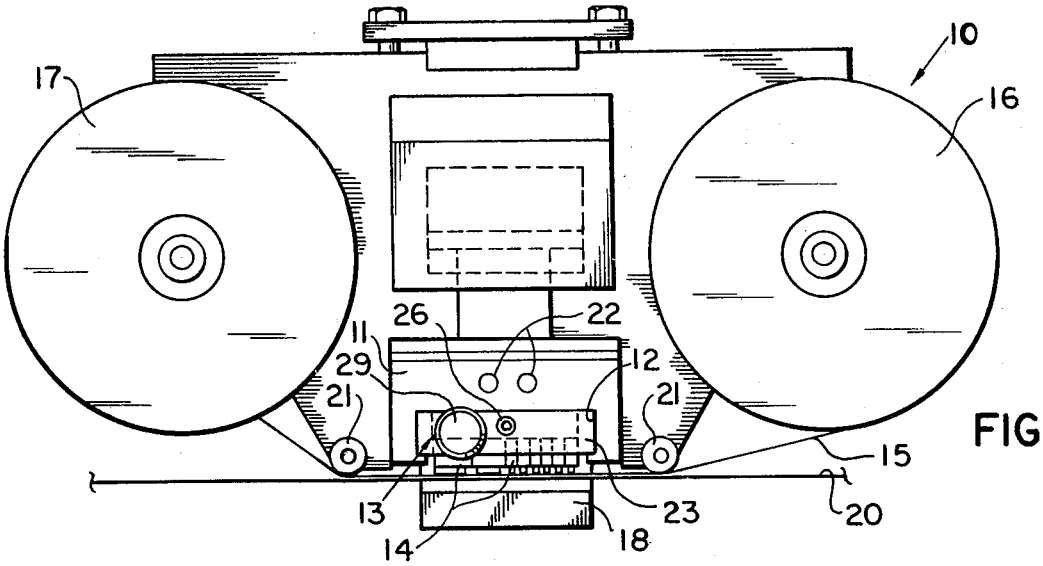
FIG. 1 is a somewhat diagrammatic elevational view of an imprinter of the type having a reciprocating heated print head and heat sensitive printing tape with a type holder of this invention mounted on the print head.

In FIG. 1 the reference numeral 10 designates generally a ribbon imprinter for packaging machines to code date, appy batch numbers, weights and other data on packages. The imprinter 10 has a reciprocating heated print head 11 having an open bottom recess 12 slidably receiving a type holder 13 of this invention to present the printing faces of type blocks 14 to a run 15 of inked ribbon or tape supplied from an unwinding reel 16 and wound on a receiving reel 17. An anvil 18 opposes the type 14 and receives thereover a run 20 of sheet material to be printed. Guide rolls 21 direct the run 15 of the inked tape over the run 20 of the material to be printed so that when the print heaad 11 reaches the bottom of its stroke, the heated type 14 will be pressed against the inked tape and ink from this tape will be imprinted on the product 20 as it passes over the anvil 18.

Mechanism (not shown) may be provided to swing the print head 11 and run 15 of the printing tape in an orbital path, advancing with the material 20 being printed and retracting from the material on a return stroke so that the material may be fed through the imprinter in a continuous motion. The print head 11 is heated as indicated at 22 by electrical heating units and the heated head in turn heats the inserted type holder 13 and the type 14 to temperatures sufficient to transfer the thermoplastic ink from the inked tape 15 to the product 20. These temperatures will vary depending on the nature of the thermoplastic ink but must be sufficient to soften or melt the ink to effect a good transfer to the product.

Figure 2:
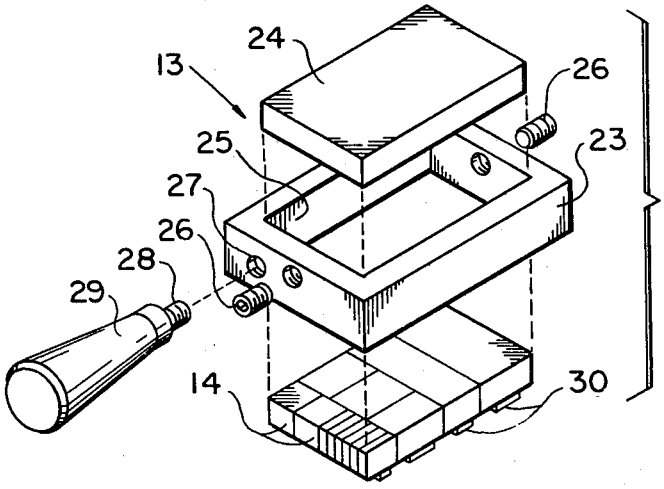
FIG. 2 is an exploded perspective view of the type holder and type of FIG. 1.

The type holder 13 of this invention is better illustrated in FIG. 2 as including a rectangular or square aluminum frame 23 slidably fitting the recess 12 of the print head 11 in snug engagement therewith. A permanent Alnico magnet in the form of a rectangular slab 24 snugly fits the central aperture 25 of the frame 23 and is held therein flush with the top face of the frame by set screws 26 threaded through the sides of the frame and biting into the ends of the magnet slab 24.

The front face of the frame 23 is tapped as indicated at 27 to receive the threaded end 28 of a handle 29 so that the handle will project forwardly from the print head to be conveniently grasped.

The type 14 are in the form of square or rectangular blocks and may have different sizes and shapes as illustrated to accommodate desired printing indicia 30 raised from their bottom faces to confront the printing tape run 15. These type blocks are relatively short since the magnet 24 when seated in the aperture 25 of the frame 23 has its top face flush with the top of the frame and its bottom face inwardly from the bottom face of the frame for a distance just sufficient to allow the frame to form a substantial shoulder or periphery surrounding the blocks to prevent them from shifting.

It will be especially noted from FIG. 1 that the frame 23 of the holder 13 has a snug fit with the walls of the recess 12 in the print head 11 with the magnet slab 24 snugly bottomed against the top wall of this recess. Excellent heat transfer from the heated print head 11 to the type holder 13 is thus ensured. In addition, it will be noted that the type blocks 14 are snugly embraced by the frame 23 and are firmly bottomed on the magnet slab 24 thereby also ensuring excellent heat transfer from the type holder to the type.

The magnet 24 creates a strong magnetic field in the frame 23 retaining the metal type blocks in tight fitting contact with the magnet. The type blocks are generally composed of steel or other metal having a high paramagnetic attraction to the magnet. The type is thus fixedly held in position in the type holder without clamps, keys, or the like expensive and cumbersome retainers.

When it is desired to change the type blocks 14 to present different indicia to the printing tape and material to be printed, an operator merely grasps the handle 24 pulling the holder out of the print head. The set screws 26 may be loosened and the magnet 24 pushed through the aperture 25 to discharge the type blocks 14 from the frame 23. A new set of blocks are then easily installed and retained by the magnet.

Figure 5:
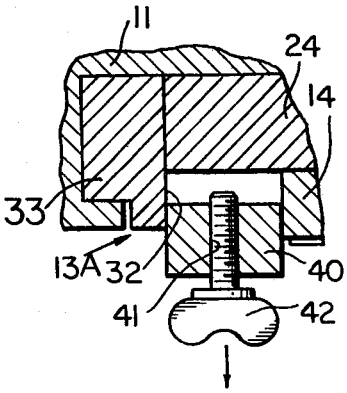
FIG. 5 is a sectional view along the line V—V of FIG. 4 illustrating a type puller to facilitate removal of the type blocks.
Figure 3:
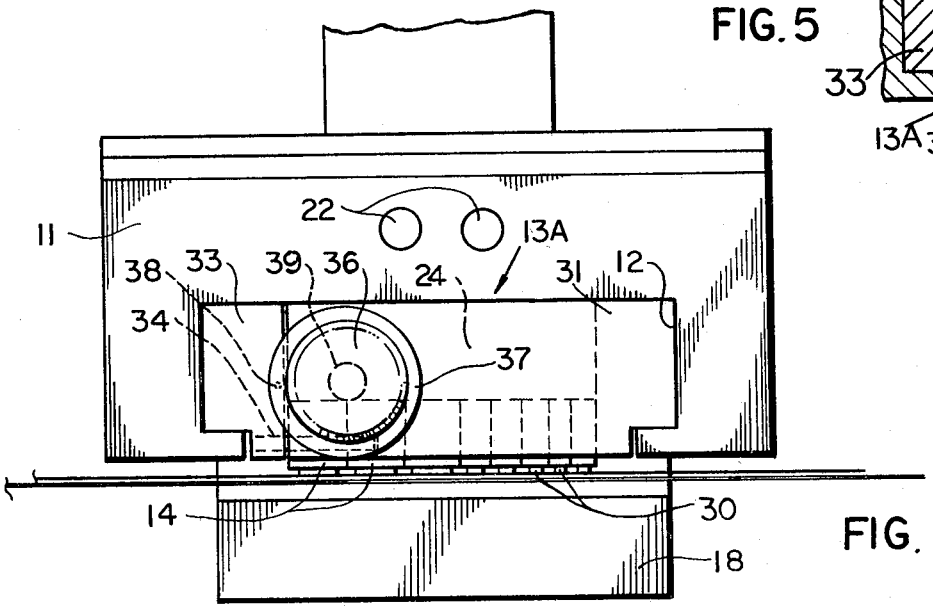
FIG. 3 is an elevational view of an imprinter print head with another form of type holder of this invention mounted therein.
Figure 4:
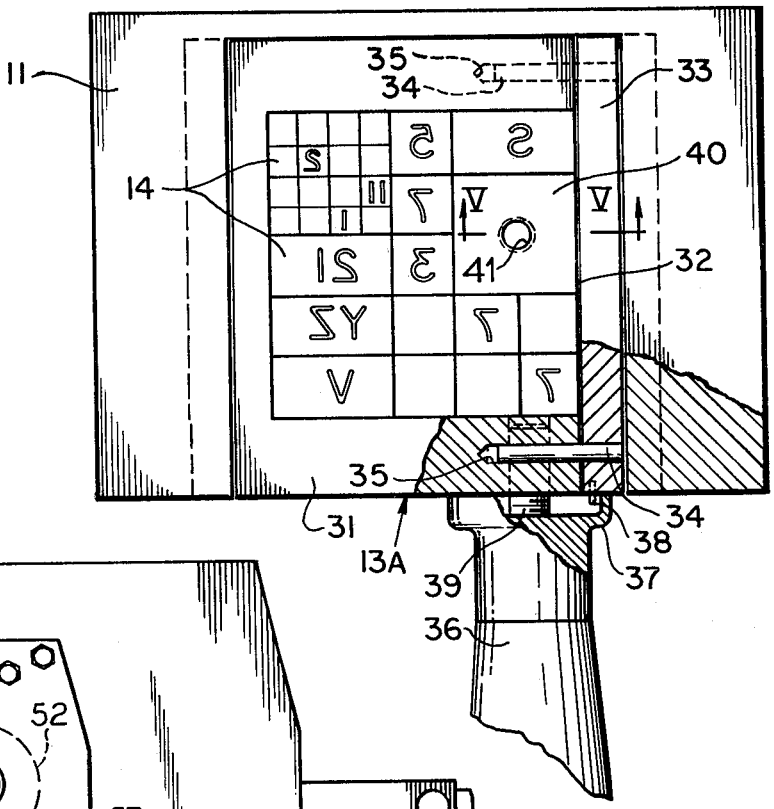
FIG. 4 is a bottom plan view of a print head and holer of FIG. 3 with parts broken away and shown in cross section.

In the embodiment shown in FIGS. 3 to 5, the reciprocating print head 11 receives a modified type holder 13A in the recess 12 thereof. This type holder 13A has a rectangular frame 31 with a through aperture 32 but with a removable side wall 33 having pins 34 snugly seated in holes 35 of the frame. The end wall 33 when bottomed on the frame 31 serves to clamp the magnet 24 and the type blocks 14 in the frame.

A handle 36 projects from the front face of the holder 13A and has a collar 37 confronting the front face of the frame 31 and the front edge of the removable end wall 33 to embrace a pin 38 on the end wall 33 thereby retaining the end wall in position on the frame when the type holder is retracted from the print head.

The handle 36 has a threaded pin end 39 which is screwed into a tapped hole in the front face of the frame 31 and when the handle is unscrewed from the frame the trapped pin 38 is released from the collar 37 and the end wall 33 may be removed to expose the type blocks 14.

The magnet 24 performs the same function in the holder 13A as described above in connection with the holder 13. However, the frame 31 with its removable end wall serves to clamp the magnet in position in the through hole or aperture 32 of the frame.

As illustrated in FIGS. 4 and 5, a spacer block 40 is included among the type blocks 14 and has a tapped hole 41 adapted to receive a thumb screw 42 so that the block may easily be pulled off of the magnet 24 and out of the recess 32 to facilitate shifting and replacement of the type blocks 14. This puller arrangement can be used in different installations to avoid removal of all of the type blocks from their frame.

Figure 6:
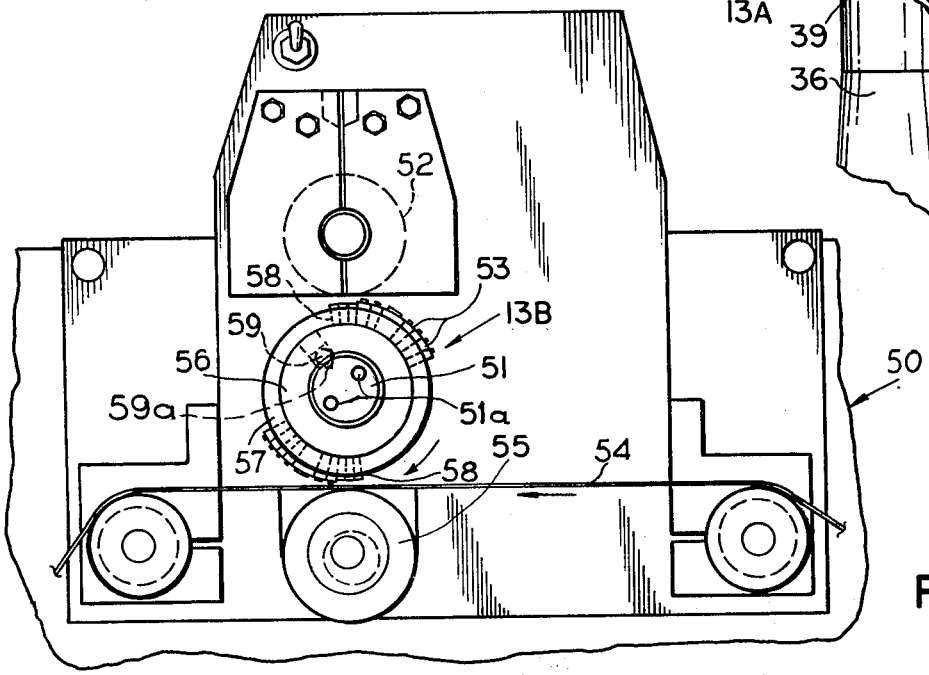
FIG. 6 is a view similar to FIG. 1 but illustrating an imprinter with a rotating print head and a type holder of this invention fitting said head.

FIG. 6 diagrammatically illustrates an imprinter 50 having a rotating print head or spindle 51 on which a type holder 13B of this invention is mounted. The imprinter 50 has an inking roll 52 contacted by the indicia or printing faces of type blocks 53 and the inked faces of the type and then rotated into contact with the material 54 to be printed as it passes over a bottom anvil roll 55.

The type holder 13B has a cylindrical permanent magnet 56 snugly receiving the rotating print head or spindle 51 which is heated for example by electrical heating elements **51*a* and the magnet thus has intimate heat transfer contact with the spindle which is also made of magnetic material such as steel. The magnet in turn is pressed into a cylindrical non-magnetic sleeve frame 57 with diametrically opposed windows or apertures 58 receiving the type blocks 52 in snug engagement therewith. These type blocks 53 are pie-shaped with tapered side walls coinciding with the radius of the sleeve 57** so that they will fit together in intimate side-by-side relation as illustrated.

While the magnetic field between the magnet 56 and the steel spindle 51 will keep the holder 13B on the spindle, a direct drive connection between the spindle and magnet is provided by spring pressed detent 59 carried in the I.D. of the magnet and fitting a dimple **59*a*** in the spindle.

The type holder 13B functions in the same manner as the above described holders 13 and 13A but is shaped and dimensioned to fit a rotating print head of an imprinter. The holder will transfer heat from the print head to the type blocks, the magnet in the holder will retain the type blocks in position, and the holder is easily applied to and removed from the print head.

Figure 7:
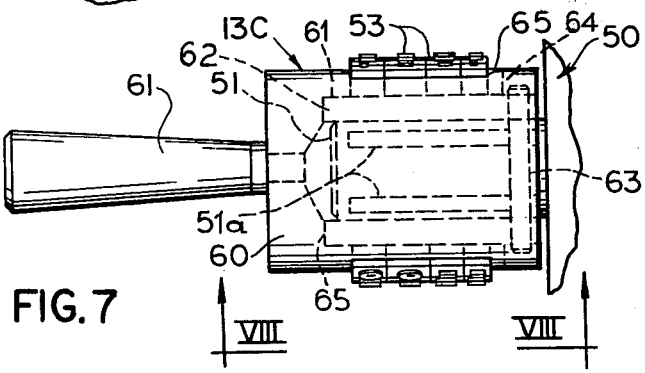
FIG. 7 is a side elevational view of another form of type holder of this invention on a rotating imprinter head or spindle.
Figure 8:
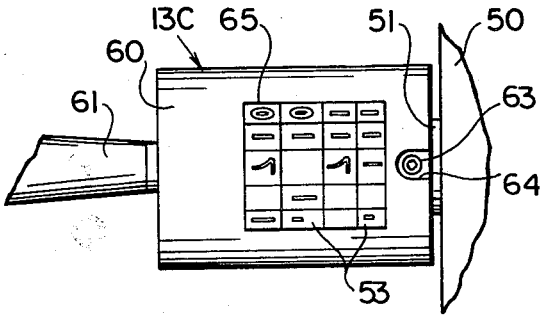
FIG. 8 is a plan view along the line VIII—VIII of FIG. 7.

FIGS. 7 and 8 illustrate another embodiment of magnetic type holder. As there shown, the type holder 13C is mounted on the rotatable heated print head or spindle 51. This holder has a cup-shaped sleeve 60 of non-magnetic heat conducting material such as aluminum with a cylindrical bore 61 receiving a cylindrical permanent magnet 62 in press fit relation. The magnet snugly seats on the spindle 52 in slidable relation and is bottomed on the closed end of the cup-shaped sleeve. The closed end overlies the end face of spindle 51 and has a non-heat-conducting handle 61 projecting therefrom.

A drive pin 63 extends through the spindle 51 and projects into open end slots or grooves 64 in the open or inner end of the cup-shaped sleeve 60. The holder 13C is thus drivingly coupled to the spindle 51 but can be easily uncoupled by pulling the sleeve off of the spindle.

The sleeve 60 has square diametrically opposed windows or apertures 65 through the side wall thereof receiving the pie-shaped type blocks 53 such as are described above. The cylindrical magnet 62 bottoms the apertures 64, holds the type tightly thereagainst, and in turn is bottomed on the spindle 51. The heated spindle 51 thus transfers heat through the magnet 62 and cup-shaped sleeve 60 to the type 53. The type can be pulled out of the windows 64 and replaced or reset.

The cup-shaped frame is thus easily applied to and removed from the spindle or rotating print head and the type can be easily replaced and rearranged in their respective windows of the frame.

From the above descriptions, it will therefore be understood that this invention provides magnetic type holders for imprinters having excellent heat transfer capacity, accommodate easy rearrangement and replacement of type, utilize shorter type blocks, and are easily installed on and removed from the existing imprinter units.

While various changes and modifications might be proposed by those skilled in the art, it will be understood that I wish to include within the claims of the patent warranted hereon all such changes and modifications as reasonably come within my contribution to the art.

I claim as my invention:

1. A type holder for an imprinter having a rotatable heated print head, an anvil opposing said head, and means for conveying a web to be printed in a path between the anvil and head, which comprises a heat conducting frame sized to have a slide fit with said print head and having an open window therethrough, a heat conductive magnet in said frame forming a bottom for said window and positioned for heat transfer relation with said head, paramagnetic type blocks in said window bottomed on said magnet and retained in the window by said magnet, said blocks having printing indicia projecting beyond the window and print head for printing a web in said path, said frame being a cup having a side wall embracing said head and an end wall overlying the head, said magnet being tightly fitted in said side wall, and a handle projecting from said end wall to mount and remove the frame from the head.

2. A type holder for a heated rotating print head spindle of an imprinter which comprises a heat conducting tubular frame having a type receiving window therethrough, a tubular heat conducting magnet secured in said frame sized for a slide fit around said spindle and forming a bottom for said window, and paramagnetic type blocks bottomed on said magnet fitted in said window and heated from the spindle through the magnet and frame.

3. The type holder of claim 2 wherein the tubular frame is nonmagnetic and the magnet is press fitted in said tubular frame.

4. The type holder of claim 2 wherein the tubular frame has a plurality of separated windows therethrough and the magnet bottoms all of the windows.

5. The type holder of claim 2 for a cylindrical spindle having a drive pin extending therefrom wherein the tubular frame is a cylindrical cup with an end wall for overlying the spindle and an open mouth with notches receiving the drive pin.

6. The type holder of claim 5 including a nonheat conducting handle projecting from side end wall to facilitate mounting and removing the holder from the spindle.

7. The type holder of claim 2 wherein the type blocks have tapered side walls coinciding with the radius of the tubular frame to fit together in intimate side-by-side relation in the window.

* * * * *